US011204169B2

(12) United States Patent
Sze

(10) Patent No.: US 11,204,169 B2
(45) Date of Patent: Dec. 21, 2021

(54) COMBUSTOR OF GAS TURBINE ENGINE AND METHOD

(71) Applicant: PRATT & WHITNEY CANADA CORP., Longueuil (CA)

(72) Inventor: Robert Sze, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 52 days.

(21) Appl. No.: 16/516,697

(22) Filed: Jul. 19, 2019

(65) Prior Publication Data

US 2021/0018178 A1 Jan. 21, 2021

(51) Int. Cl.

| | |
|---|---|
| ***F23R 3/00*** | (2006.01) |
| ***F23R 3/52*** | (2006.01) |
| ***F23R 3/46*** | (2006.01) |
| ***F23R 3/44*** | (2006.01) |
| ***F01D 9/02*** | (2006.01) |
| ***F23R 3/60*** | (2006.01) |
| ***F23R 3/50*** | (2006.01) |
| ***F23R 3/06*** | (2006.01) |

(52) U.S. Cl.

CPC ..... *F23R 3/52* (2013.01); *F01D 9/023* (2013.01); *F23R 3/002* (2013.01); *F23R 3/06* (2013.01); *F23R 3/44* (2013.01); *F23R 3/46* (2013.01); *F23R 3/50* (2013.01); *F23R 3/60* (2013.01); *F23R 2900/03044* (2013.01)

(58) Field of Classification Search

None

See application file for complete search history.

(56) References Cited

U.S. PATENT DOCUMENTS

| | | | | |
|---|---|---|---|---|
| 4,749,029 | A * | 6/1988 | Becker | F23R 3/002 165/169 |
| 5,165,226 | A * | 11/1992 | Newton | F23R 3/12 60/750 |
| 6,711,900 | B1 | 3/2004 | Patel et al. | |
| 8,794,006 | B2 | 8/2014 | Chokshi et al. | |
| 2004/0159106 | A1* | 8/2004 | Patel | F23R 3/06 60/798 |
| 2016/0258624 | A1* | 9/2016 | Harding | F23M 5/04 |
| 2016/0263712 | A1* | 9/2016 | Ivory | F23R 3/007 |
| 2016/0305663 | A1* | 10/2016 | Lebel | F23R 3/002 |
| 2016/0377296 | A1* | 12/2016 | Bangerter | F23R 3/06 60/752 |

FOREIGN PATENT DOCUMENTS

| | | |
|---|---|---|
| FR | 2947035 A1 | 12/2010 |

* cited by examiner

*Primary Examiner* — Edwin Kang

(74) *Attorney, Agent, or Firm* — Norton Rose Fulbright Canada LLP

(57) ABSTRACT

A combustor for a gas turbine engine includes a liner enclosing a combustion chamber and defining air passages through the liner, a fuel nozzle fluidly connected to the combustion chamber, and a louver disposed inside the combustion chamber over the air passages. The louver extends circumferentially along the liner and is connected to the liner by a fastener. The fastener spacing at least one of axial edges of the louver from the liner to define an air outlet between the at least one of the axial edges and the liner. A method of manufacturing a combustor of an aircraft engine is also disclosed.

20 Claims, 8 Drawing Sheets

COMBUSTOR OF GAS TURBINE ENGINE AND METHOD

TECHNICAL FIELD

The application relates to combustors for gas turbine engines.

BACKGROUND OF THE ART

While prior art combustors for gas turbine engines may be suitable for their intended purposes, improvements in aviation technologies are always desirable.

SUMMARY

In one aspect, there is provided a combustor for a gas turbine engine having a rotation axis, the combustor comprising: a liner enclosing a combustion chamber extending along an axial direction relative to the rotation axis, the liner defining air passages through the liner into the combustion chamber, a fuel nozzle fluidly connected to the combustion chamber upstream of the air passages, and a louver disposed inside the combustion chamber over the air passages, the louver extending circumferentially along the liner relative to the rotation axis from a first circumferential end of the louver to a second circumferential end of the louver and having a front-facing axial edge facing toward the fuel nozzle and a rear-facing axial edge facing away from the fuel nozzle, the louver connected to the liner by a fastener, the fastener spacing at least one of the axial edges from the liner to define an air outlet between the at least one of the axial edges and the liner.

In some embodiments, the at least one of the axial edges is the front-facing axial edge and the air outlet is an only air outlet in a radial direction between the front-facing axial edge the liner; and the rear-facing axial edge and the liner define a rear-facing air outlet between the rear-facing axial edge and the liner, the rear-facing air outlet extending from the first circumferential end of the louver to the second circumferential end of the louver.

In some embodiments, combustor comprises a divider wall extending from the liner to the louver, the divider wall disposed between the front-facing and rear-facing air outlets and between the air passages such that some of the air passages supply air to the front-facing air outlet and a rest of the air passages supply air to the rear-facing air outlet.

In some embodiments, the liner includes an annular outer liner extending about a central axis of the combustor; the louver and the divider wall extend circumferentially along a portion of the outer liner relative to the central axis; and an end wall is disposed at each of opposed circumferential ends of the louver, the end walls defining the front-facing and rear-facing air outlets.

In some embodiments, the front-facing air outlet has a total airflow exit area that is between 2 to 3 times a total airflow exit area of the air passages supplying air to the front-facing air outlet, and the rear-facing air outlet has a total airflow exit area that is between 2 to 3 times a total airflow exit area of the air passages supplying air to the rear-facing air outlet.

In some embodiments, the total airflow exit area of the air passages supplying air to the front-facing air outlet is greater than the total airflow exit area of the air passages supplying air to the rear-facing air outlet.

In some embodiments, the combustor comprises a plurality of thumbnail air outlets disposed on a side of the louver opposite the divider wall, each of the thumbnail air outlets being fluidly connected to at least one of: the first air passages, and an air source disposed outside of the liner; the combustion chamber includes a primary zone in a front portion of the combustion chamber, and a dilution zone downstream of the primary zone; the louver, the divider wall, and the first air passages are positioned between the primary zone and the dilution zone; the liner defines therethrough air passages opening into the primary zone of the combustion chamber; the liner includes an annular inner liner, the inner liner defining at least one primary jet air passage through the inner liner, the at least one primary jet air passage opening into the combustion chamber between the primary zone and the dilution zone; and the air passages opening into the primary zone and the at least one primary jet air passage are sized and oriented such that air flowing into the combustion chamber during operation through the air passages opening into the primary zone and the at least one primary jet air passage generates a toroidal flow of combustion gases in the primary zone, the toroidal flow of combustion gases impinging upon the louver and the thumbnail air outlets.

In some embodiments, the louver, the divider wall, the front-facing and rear-facing air outlets, and the thumbnail air outlets are part of an air film starter threadingly attached to the outer liner; the air film starter is a plurality of film starters distributed circumferentially along the outer liner; the fuel nozzle is a plurality of fuel nozzles disposed upstream of the plurality of film starters; and each fuel nozzle of the plurality of fuel nozzles aligns axially with at least one film starter of the plurality of film starters.

In some embodiments, the plurality of film starters covers substantially an entirety of a circumference of the outer liner.

In some embodiments, the louver has a rectangular cross-section.

In another aspect, there is provided a combustor for a gas turbine engine, the combustor comprising: an outer liner and an inner liner defining an annular combustion chamber between the outer liner and the inner liner; a fuel nozzle disposed in a front portion of the combustion chamber; a plurality of air passages defined through the outer liner downstream of the fuel nozzle; and an air film starter disposed inside the combustion chamber and connected to the outer liner via a threaded stud, the air film starter defining: a front-facing elongate air outlet directing air from at least one of the plurality of air passages along the outer liner toward the fuel nozzle when the combustor is in use; and a rear-facing elongate air outlet directing air from at least one of the plurality of air passages along the outer liner away from the fuel nozzle when the combustor is in use.

In some such embodiments, the air film starter includes a louver disposed inside the combustion chamber proximate to and spaced from the outer liner, and opposed axial edges of the louver define respective ones of the front-facing and rear-facing elongate air outlets between respective ones of the opposed axial edges and the outer liner.

In some such embodiments, the front-facing elongate air outlet extends radially inward of the outer liner; and the rear-facing elongate air outlet extends radially inward of the outer liner.

In some such embodiments, the threaded stud is one of: a plurality of bolts distributed circumferentially along the outer liner and extending into the combustion chamber through the outer liner and connecting to the air film starter; and a plurality of threaded studs extending from the air film starter out of the combustion chamber through the outer liner.

In some such embodiments, the air film starter includes a divider wall extending from the outer liner to the louver between opposed circumferential ends of the louver, and an end wall at each of the opposed circumferential ends, the end walls defining the front-facing and rear-facing elongate air outlets, the divider wall fluidly separating the plurality of air passages into: at least a first air passage supplying air to the front-facing elongate air outlet when the combustor is in use, and at least a second air passage supplying air to the rear-facing elongate air outlet when the combustor is in use.

In some such embodiments, the air film starter is coated with a Platinum-Aluminide coating.

In some such embodiments, the air film starter is one of: cast, made as a single crystal, and metal injection molded, from a B1900Hf alloy.

In yet another aspect, there is provided a method of manufacturing a combustor of an aircraft engine, comprising: forming an outer liner and an inner liner to define a combustion chamber of the combustor; fluidly connecting a fuel nozzle to a front portion of the combustion chamber for injecting fuel into a primary zone of the combustion chamber; forming air passages through the outer liner and the inner liner around the primary zone to provide an air supply pattern into the primary zone that creates a toroidal flow of combustion gases in the primary zone during operation of the combustor, the toroidal flow impinging upon a circumferential portion of the outer liner downstream of the fuel nozzle; forming an air passage through the outer liner in the circumferential portion of the outer liner; and attaching a louver via a fastener to the outer liner at a location opposite the air passage inside the combustion chamber such that an axial edge of the louver is spaced from the outer liner to define an elongate air outlet between the axial edge and the outer liner.

In some embodiments, the axial edge is one of two opposed axial edges of the louver, and the attaching the louver via the fastener spaces both of the opposed axial edges from the outer liner to define opposed elongate air outlets, the elongate air outlet being one of the opposed elongate air outlets.

In some embodiments, the method comprises attaching the fastener to a side of the louver facing the outer liner at a location between the opposed axial edges.

In yet another aspect, there is provided a method of creating an air film in a combustion chamber of a combustor of an aircraft engine, comprising: during operation of the combustor, supplying air into a primary zone of the combustion chamber to generate a toroidal flow of combustion gases in the primary zone, the toroidal flow of combustion gases impinging upon a circumferential portion of an outer liner defining/enclosing the combustion chamber; and supplying air into the combustion chamber along the outer liner from front-facing elongate air outlets spanning the circumferential portion of the outer liner.

In some such embodiments, the method further comprises supplying air into the combustion chamber along the outer liner from rear-facing elongate air outlets spanning the circumferential portion of the outer liner.

In some such embodiments, the method further comprises supplying air into the combustion chamber in a circumferential direction along the circumferential portion of the outer liner from outlets positioned radially inward of the front-facing and the rear-facing elongate air outlets relative to a central axis of the combustor.

DESCRIPTION OF THE DRAWINGS

Reference is now made to the accompanying figures in which:

FIG. 1A is a schematic cross section side view of an aircraft engine;

FIG. 6 is a schematic diagram showing a method of manufacturing a combustor of an aircraft engine.

DETAILED DESCRIPTION

While the air film starter technology of the present application is described herein with respect to a particular type of aircraft engine and combustor, the air film starter technology of the present application may likewise be used with other types of aircraft engines and/or other types and/or embodiments of combustors. Axial (XA), radial (XR), circumferential (XC), axially forward (F), and axially rearward (R) directions as referred to in the present document are shown with corresponding arrows in the figures. Various airflows and air passages have been shown with arrows in the figures.

To maintain clarity of the figures, only some of the airflows and passages have been labeled. For the purposes of this document, the term "elongate outlet" is used to distinguish the outlet from circular outlets, and means that the outlet has a width or length, depending on the orientation of the outlet, which is greater than its height. Further, for the purposes of this document, the term "outlet" means an outlet defined by two or more surfaces that are spaced from each other, and excludes a gap that may be left between two surfaces abutting each other and/or being compressed against each other, which gap may pass airflow therethrough.

FIG. 1A illustrates an aircraft engine 1A, which may be part of an aircraft, such as a conventional aircraft for example. In this example, the engine 1A is a turboshaft engine 1A, but may be any other type of aircraft engine. In this embodiment, the engine 1A includes in serial flow communication a low pressure compressor section (LPC) and a high pressure compressor section (HPC) for pressurizing air. The engine 1A further includes a high pressure turbine section (HPT) and a lower pressure turbine section (LPT). The respective pairs of the compressor and turbine sections are interconnected via respective independently rotatable low pressure and high pressure spools (LPS), (HPS). The engine 1A includes a transmission (T) driven by the low pressure turbine section (LPT) for outputting motive power to an aircraft.

The engine 1A further includes a combustor 10 in which the compressed air is mixed with fuel and ignited for generating combustion gases that may be used to power the high pressure turbine section (HPT) and a lower pressure turbine section (LPT). In this embodiment, the combustor 10 is of an annular type and has a central axis 10X. The combustor 10 is disposed about a rotation axis (X) of the engine 1A such that the central axis 10X of the combustor 10 coincides with the rotation axis (X) of the engine 1A. It is contemplated that in some embodiments and applications, a different arrangement may be used.

Figure 1B:
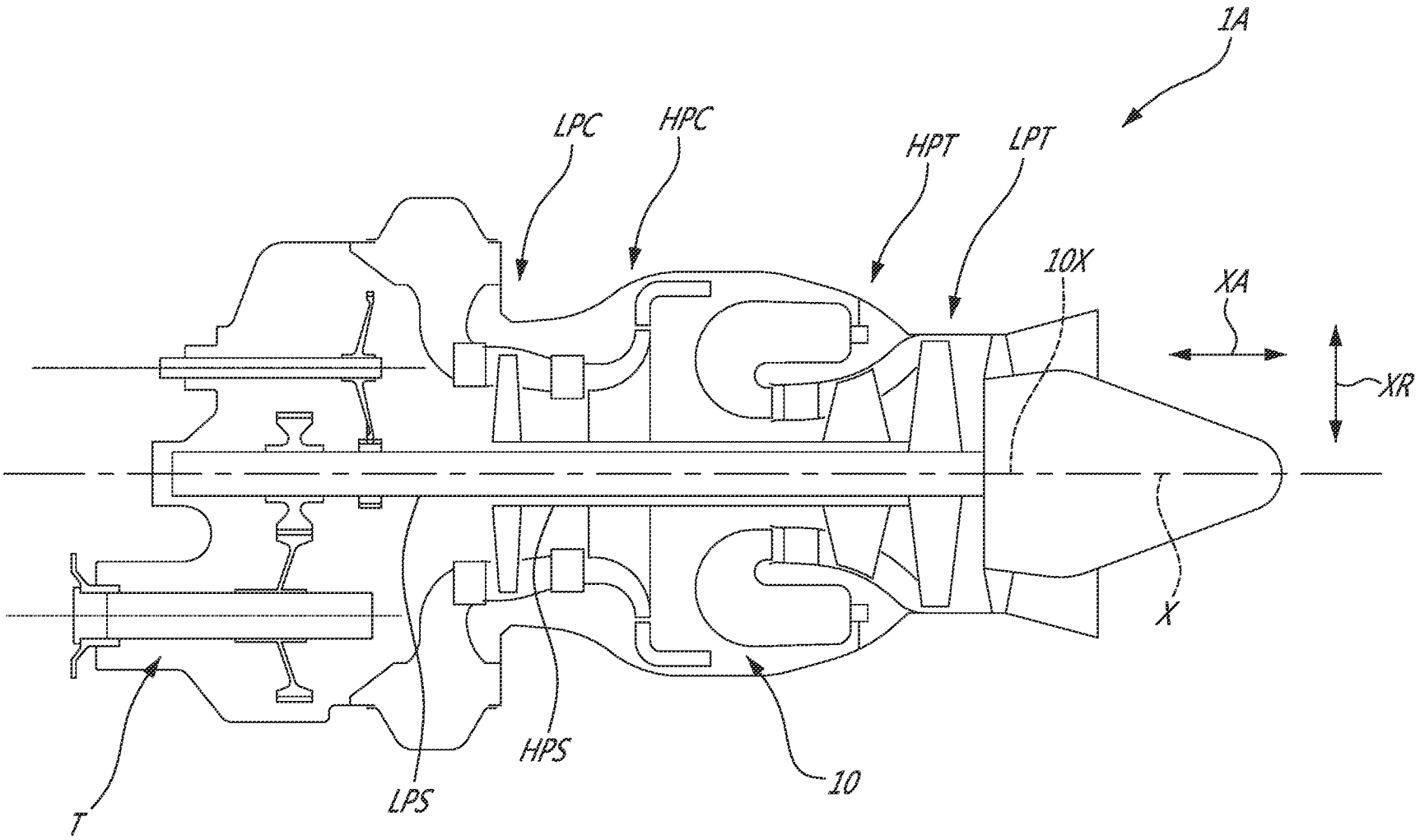
FIG. 1B is a schematic cross section side view of a part of a combustor of the aircraft engine of FIG. 1A, taken along a vertical longitudinal center plane passing through a rotation axis of the engine.
Figure 1B:
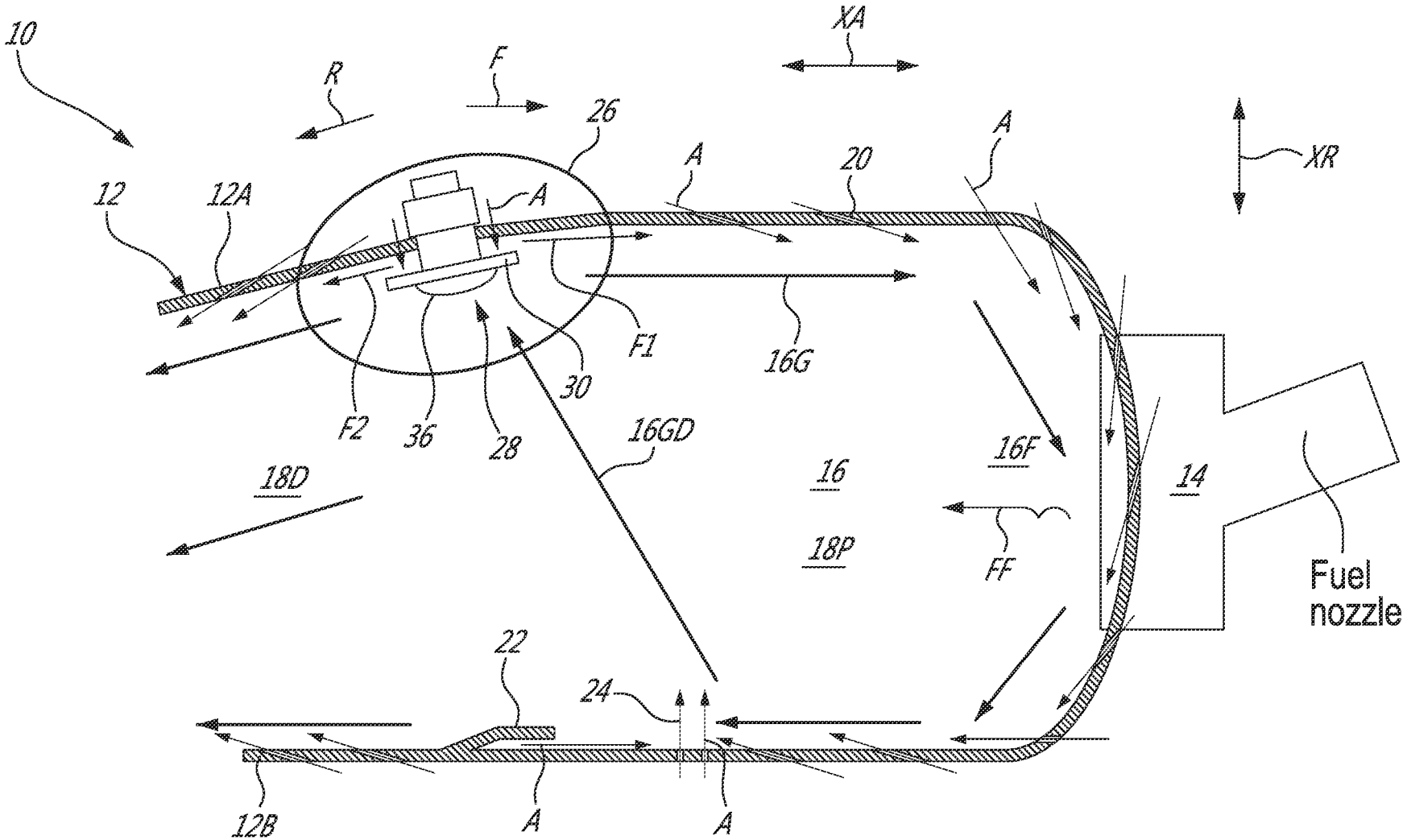

FIGS. 1B and 10 illustrate the combustor 10 in more detail. As shown, in this embodiment, the combustor 10 includes a liner 12. The liner 12 includes an annular outer liner 12A and an annular inner liner 12B that together define/enclose a combustion chamber 16 between the outer liner 12A and the inner liner 12B. A plurality of fuel nozzles 14 are disposed in and/or extend and/or open into a front portion 16F of the combustion chamber 16. In this embodiment, the fuel nozzles 14 are distributed circumferentially about the front portion 16F of the combustion chamber 16, as shown with dotted lines in FIG. 10 to maintain clarity of the figure. To maintain clarity of the figures and this description, only one of the fuel nozzles 14 is labeled and only two of the fuel nozzles 14 are shown in FIG. 10. It is contemplated that the combustion chamber 16 may include any number and any arrangement of fuel nozzles 14 suitable for each particular embodiment and application of the combustion chamber 16.

Referring to FIG. 1B, as shown with arrow (FF), each of the fuel nozzles 14 is operable to inject fuel into a primary zone 18P of the combustion chamber 16. During operation, the fuel (FF) is mixed with air (A) supplied into the primary zone 18P of the combustion chamber 16 via a first set of air passages 20 defined through the outer and inner liners 12A, 12B in the primary zone 18P of the combustion chamber 16. To maintain clarity of the figures and this description, only one of the air passages 20 is labeled and only two of the air passages 20 are shown with parallel lines traversing the liner 12. The rest of the air passages 20 are shown with arrows (A), only some of which are labeled to maintain clarity. The resulting fuel-air mixture is combusted in the combustion chamber 16. The combustion creates combustion gases that flow from the combustion chamber 16 to the various components, such as the high pressure turbine section (HPT) and the lower pressure turbine section (LPT) of the engine 1A to power the engine 1A.

It is contemplated that any suitable ignition and/or flame holding arrangement may be used to initiate and/or maintain combustion, and therefore these elements are not described in detail herein. It is contemplated that any suitable fluid connection(s) and/or shape of the combustor 10 may be used for directing the combustion gases through the engine 1A. Therefore, to maintain clarity, these elements and details are not described in detail herein.

Figure 1C:
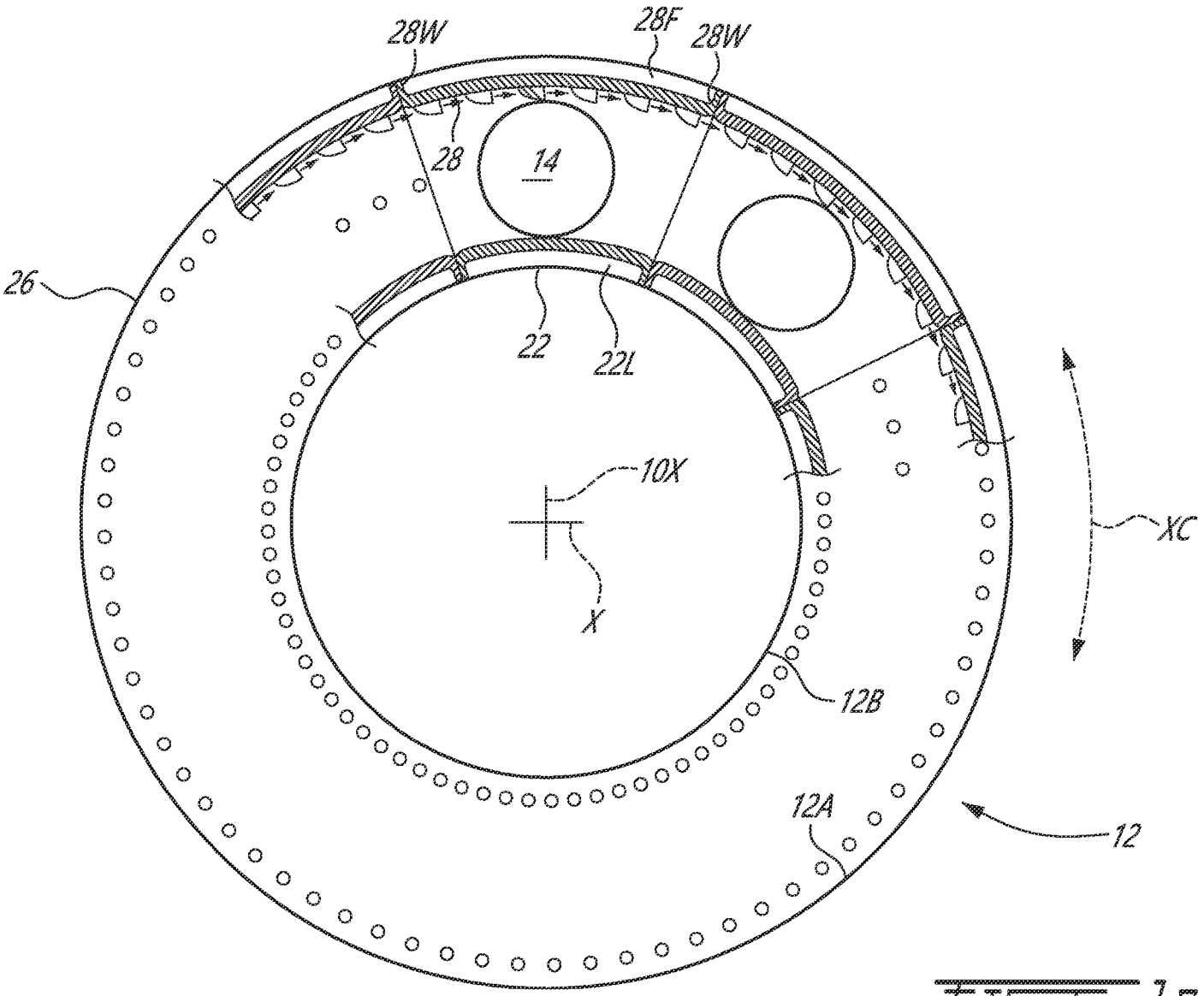
FIG. 1C is a schematic cross section of the combustor of FIG. 1A, taken in a rearward direction along a vertical transverse plane that is orthogonal to the vertical longitudinal center plane.

In this embodiment, the combustor 10 further includes one or more primary air jet louvers 22 disposed circumferentially along, as shown with arrow (XC) in FIG. 1*c*, and/or defined by the inner liner 12B. As shown, the primary air jet louvers 22 span a circumferential portion of the inner liner 12B, which is disposed between the primary zone 18P of the combustion chamber 16 and a dilution zone 18D of the combustion chamber 16 that is downstream of the primary zone 18P. More particularly, as shown in FIG. 10, the primary air jet louvers 22 define front-facing (i.e. facing the front portion 16F of the combustion chamber 16) elongate air outlets 22L that span substantially the entirety of the circumferential portion 12C of the inner liner 12B, as shown with dotted lines in FIG. 10 to maintain clarity of the figure. To maintain clarity, only one of the elongate air outlets 22L, further referred to as "inner elongate air outlets 22L", is labeled and only two of the inner elongate air outlets 22L are shown in their entirety in FIG. 1C. It is contemplated that the combustion chamber 16 may include any number and/or configuration and/or shape of inner elongate air outlets 22L suitable to provide for the functionality described herein.

The primary air jet louvers 22 thus define air passages that include the inner elongate air outlets 22L and direct air flowing into the combustion chamber 16 via air passages 20 corresponding to the primary air jet louvers 22 (i.e. the air passages 20 disposed radially inward of the louvers 22), along the inner liner 12B toward the front portion 16F of the combustion chamber 16, and hence toward the fuel nozzles 14. As shown in FIG. 1B, the first set of air passages 20 and the inner elongate air outlets 22L (a.k.a. primary jet air passages 22L) are sized and oriented such that air (A) flowing into the combustion chamber 16 during operation of the combustor 10 through the first set of air passages 20 and the inner elongate air outlets 22L generates a toroidal flow 16G of combustion gases in the primary zone 18P of the combustion chamber 16.

As shown with arrow 16GD, the toroidal flow 16G impinges upon a circumferential portion 26 of the outer liner 12A. From the primary zone 18P, the combustion gases flow axially rearward downstream of the circumferential portion 26 into and through the dilution zone 18D of the combustion chamber 16. Thus, the circumferential portion 26 of the outer liner 12A may be said to be disposed between the primary zone 18P and the dilution zone 18D, and/or may be part of the primary zone 18P and/or the dilution zone 18D.

Referring to FIGS. 1B and 10, in the present embodiment, to help protect the circumferential portion 26 of the outer liner 12A, the combustor 10 includes a plurality of air film starters 28. To maintain clarity, only one of the air film starters 28 is labeled and only two of the air film starters 28 are shown in their entirety in FIG. 10. As schematically shown in FIG. 10 with dotted lines to maintain clarity of the figure, in this embodiment, the film starters 28 are distributed and extend circumferentially along the outer liner 12A and span substantially an entirety of the circumferential portion 26 of the outer liner 12A. In an aspect, this arrangement helps protect an entirety of the circumferential portion 26 from the heat of the impinging portion 16GD of the toroidal flow 16G of the combustion gases.

In the present embodiment, the number of the air film starters 28 equals to the number of the fuel nozzles 14, with one air film starter 28 being aligned axially with a corresponding one of the fuel nozzles 14 as shown in FIG. 10. In at least some embodiments, each given fuel nozzle 14 may generate a fuel and/or combustion gas flow pattern that may be different from the fuel and/or combustion gas flow pattern of one or more of the other fuel nozzle(s) 14, if any. Hence, in an aspect, a 1-to-1 air film starters 28 to fuel nozzles 14 arrangement may help provide a more efficient combustion pattern for each of the fuel nozzle(s) 14.

In some embodiments, the combustor 10 may have a different air film starters 28 to fuel nozzles 14 arrangement. For example, in some embodiments, the number of the air film starters 28 may be a multiple of the number of the fuel nozzles 14. As a more particular non-limiting example, in some embodiments, the number of the air film starters 28 may be ½ of the number of the fuel nozzles 14. In some such embodiments, each air film starter 28 may be sufficiently long in the circumferential direction (XC) so as to axially align with two corresponding fuel nozzles 14 and/or to cover with a film of air the portion of the circumferential portion 26 of the outer liner 12A that may otherwise be contacted by combustion gases produced by the two corresponding fuel nozzles 14.

Figure 2B:
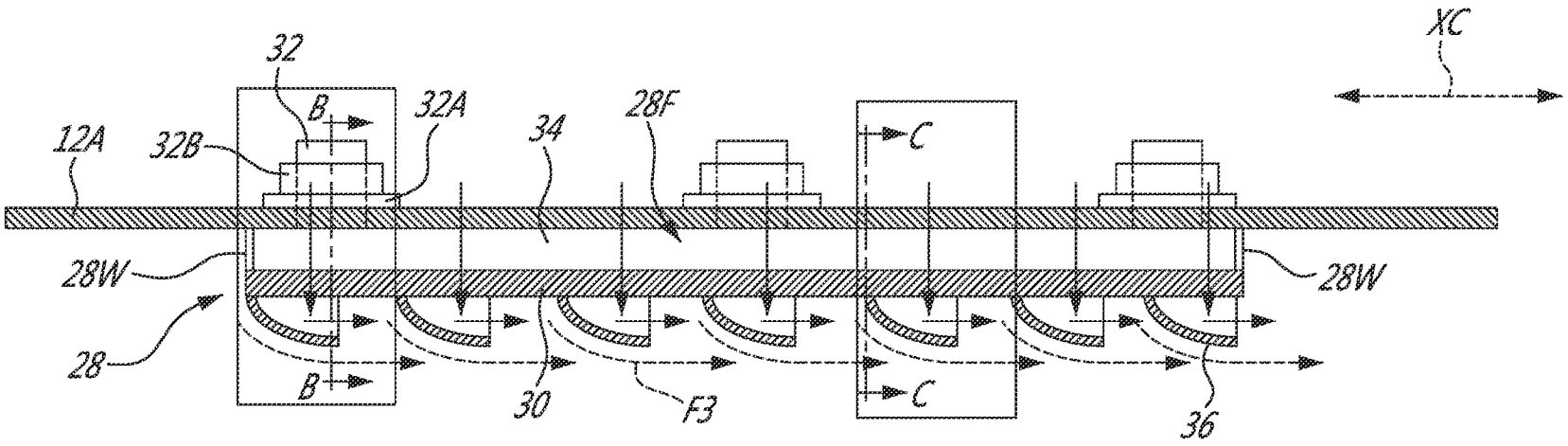
FIG. 2B is a schematic cross section view of the air film starter of FIG. 2A, taken along section line B-B of FIG. 2A.
Figure 2C:
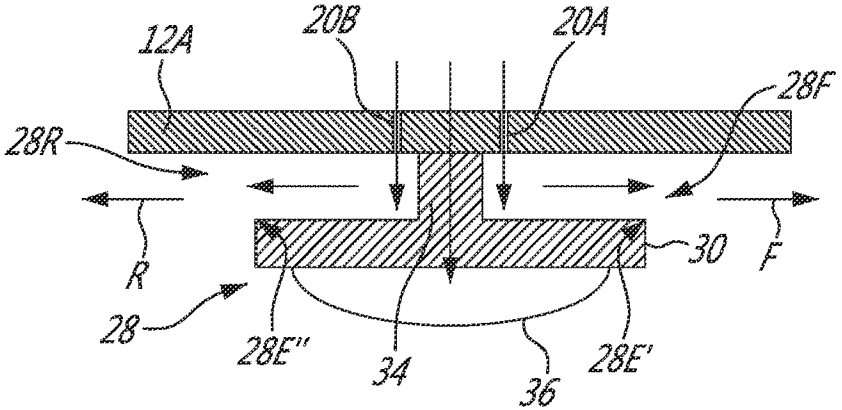
FIG. 2C is a schematic cross section view of the air film starter of FIG. 2A, taken along section line C-C of FIG. 2A.
Figure 2D:
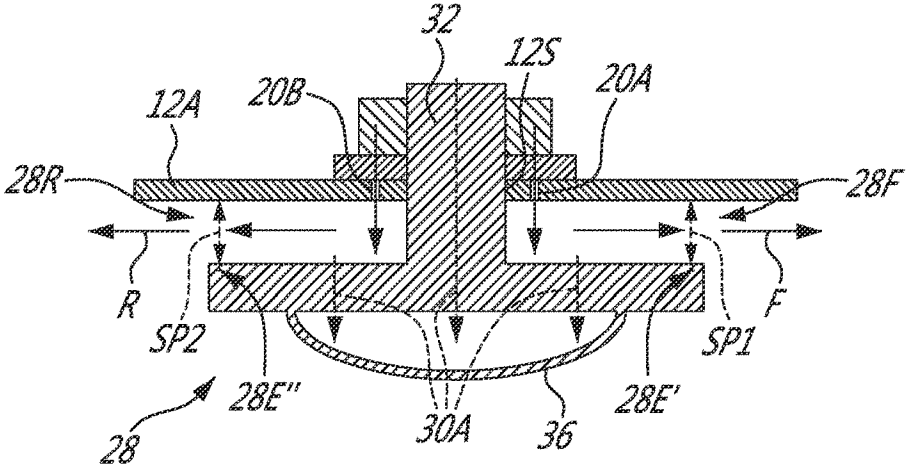
FIG. 2A is a schematic front elevation view of an air film starter of the combustor of FIG. 1B.

In some embodiments, the air film starters 28 may be similar to each other. In other embodiments, one or more of the air film starters 28 may be different from each other such as by having one or more different features and/or one or more different shape(s) and/or dimension(s) selected to suit the corresponding fuel nozzle(s) 14. To maintain clarity of this description, various embodiments of the construction of only one of the air film starters 28 are described in detail herein next, with reference to FIGS. 2A to 2C. It is noted that for simplicity, the arcuate portion of the annular outer liner 12A, and the one of the air film starters 28, shown in FIGS. 2A to 2C are both shown as straight elements. It is contemplated that the outer liner 12A and the air film starters 28 may have any suitable one or more curvatures and shapes to suit each particular embodiment and size of the combustor 10.

Referring to FIG. 2A, in the present embodiment, the air film starter 28 includes a louver 30 disposed inside the combustion chamber 16 proximate to and spaced, as shown with arrows (SP1) and (SP2), from the outer liner 12, over air passages 20A, 20B defined through the outer liner 12 that bring air (A) into the combustion chamber 16. The louver 30 is connected to and spaced from the outer liner 12A using one or more threaded studs 32, which may are examples of fasteners that may be integral to or attached to the louver 30. As shown, the one or more threaded studs 32 may extend through the liner 12A, and may space the louver 30 from the outer liner 12 such that a front-facing axial edge 28E' of the louver 30 defines a front-facing (i.e. facing the front portion 16F of the combustion chamber 16) elongate air outlet 28F between the front-facing axial edge 28E' and the outer liner 12A, and such that a rear-facing axial edge 28E" of the louver 30 defines a rear-facing (i.e. facing away from the front portion 16F of the combustion chamber 16) elongate air outlet 28R between the rear-facing axial edge 28E" and the outer liner 12A.

As shown in FIGS. 1*c* to 2*c* for example, in this embodiment, each of the air outlets 28F, 28T receives air from one or more of the air passages 20A, 20B. In this embodiment, each of the air outlets 28F, 28T extends from a first circumferential end (at wall 28W) of the louver 30 to a second circumferential end (at the other wall 28W of the louver 30, opposite the first circumferential end) of the louver 30, with no structures and hence no impedances to airflow extending across either of the air outlets 28F, 28T. While the no-structure/impedance embodiments may provide advantages in cooling efficiency for example, it is contemplated that in some embodiments, one or more structures, such as a mesh for example, may extend across one or both of the elongate air outlets 28F, 28T. It is contemplated that in some embodiments, the air film starter 28 may define only one of the front-facing elongate air outlet 28F and the rear-facing elongate air outlet 28R for example.

The spacings (SP1) and (SP2) referred to above are measured along a radial direction between the respective axial edges 28E', 28E" and the respective parts of the outer liner 12A. Further as seen in FIG. 1B, in this embodiment, the front-facing elongate air outlet 28F extends radially (XR) inward of the outer liner 12A, and the rear-facing elongate air outlet 28R extends radially (XR) inward of the outer liner 12. Also in this embodiment, and although need not be the case in other embodiments, the liner 12A proximate to the air film starter 28A has a cross section that is free of material cavities or depressions. In some embodiments, the spacing (SP1) is equal to the spacing (SP2).

In some embodiments, the spacing (SP1) may be selected such that a total airflow exit area of the front-facing elongate air outlet 28F may be between 1.5 to 4 times a total airflow exit area of the air passages 20A and/or 20B (as applicable in each embodiment) supplying air to the front-facing elongate air outlet 28F. In some embodiments, the spacing (SP1) may be selected such that the total airflow exit area of the front-facing elongate air outlet 28F may be between 2 to 3 times a total airflow exit area of the air passages 20A and/or 20B (as applicable in each embodiment) supplying air to the front-facing elongate air outlet 28F. In some embodiments, the spacing (SP2) may be selected such that a total airflow exit area of the rear-facing elongate air outlet 28R may be between 1.5 to 4 times a total airflow exit area of the air passages 20B and/or 20A (as applicable in each embodiment) supplying air to the rear-facing elongate air outlet 28R.

In some embodiments, the spacing (SP2) may be selected such that the total airflow exit area of the rear-facing elongate air outlet 28R may be between 2 to 3 times the total airflow exit area of the air passages 20B and/or 20A (as applicable in each embodiment) supplying air to the rear-facing elongate air outlet 28R. In some embodiments, the spacing (SP1) may be larger than the spacing (SP2) to provide for more airflow through the front-facing elongate air outlet 28F than through the rear-facing elongate air outlet 28R. In some applications, such an unequal flow distribution may help protect at least a part of the outer liner 12A that defines the primary zone 18P which may be hotter than the dilution zone 18D.

Although the above arrangements and/or ranges of airflow exit areas may provide advantages in some applications, in other embodiments, the spacing (SP1) may be different from the spacing (SP2) and/or the spacings (SP1), (SP2) may have different magnitudes that may not fall into the abovementioned ranges.

Referring to FIGS. 2A to 2C, although this may not be the case in other embodiments, in the present embodiment the louver 30 has a straight rectangular cross section. Also in this embodiment, the louver 30 is elongate and arcuate in the circumferential direction (XC). Also in this embodiment, the louver 30 has no walls extending along an entirety of its curved length in the circumferential direction (XC). In this embodiment, the curvature of the louver 30 conforms to the curvature of the outer liner 12A, however in other embodiments this may not be the case. While the straight rectangular cross section may provide advantages in, for example, at least some aspects of manufacturing of the present embodiment, in other embodiments, the louver 30 may have one or more different cross sections, such as one or more curved and/or arced rectangular and/or non-rectangular cross sections.

As best shown in FIGS. 2B and 2C, the outer liner 12A defines therethrough the air passages 20A, 20B over which the louver 30 is positioned. The passages 20A, 20B may be fed with air (A) from any suitable air source(s) outside of the combustion chamber 16. Thus, as shown, the louver 30 is disposed over the air passages 20A, 20B and faces the air passages 20A, 20B. The louver 30 thereby redirects air flowing/being supplied into the combustion chamber 16 via the air passages 20A, 20B out of the front-facing and the rear-facing elongate air outlets 28F, 28R.

In this embodiment, and although this need not be the case in other embodiments, the air film starter 28 includes a divider wall 34. In this embodiment, the divider wall 34 extends from the outer liner 12A to the louver 30 and is disposed between the front-facing and rear-facing elongate air outlets 28F, 28R, and in this embodiment also between the air passages 20A, 20B. More particularly, the divider wall 34 extends between the air passages 20A and the air passages 20B, between opposed circumferential ends of the louver 30. The divider wall 34 forces air flowing through the air passages 20A to flow out of the front-facing elongate air outlet 28F, and the air flowing through the air passages 20A to flow out of the rear-facing elongate air outlet 28R.

Stated otherwise, the divider wall 34 may fluidly separate the plurality of air passages 20A, 20B into: at least a first air passage 20A supplying air to the front-facing elongate air outlet 28F when the combustor 10 is in use, and at least a second air passage 20B supplying air to the rear-facing elongate air outlet 28R when the combustor is in use. It is contemplated that any number of the air passages 20A and the air passages 20B may be used to suit each particular embodiment of the combustor 10, including for example an appropriately dimensioned single air passage 20A and an appropriately dimensioned single air passage 20B.

In an aspect, the divider wall 34 helps predefine and/or control the magnitude of the airflow coming out of each of the front-facing elongate air outlet 28F and the rear-facing elongate air outlet 28R. As a non-limiting example, in some embodiments, the air passages 20A and the front-facing elongate air outlet 28F may be dimensioned to provide an effective airflow diameter that is larger than an effective airflow diameter provided by the air passages 20B and the rear-facing elongate air outlet 28R. This may help provide more airflow out of the front-facing elongate air outlet 28F.

As noted above, in some applications, this larger axially forward (F) airflow may help protect at least a part of the outer liner 12A that defines the primary zone 18P which may be hotter than the dilution zone 18D. In summary, whether or not an unequal airflow arrangement is implemented, the front-facing and the rear-facing elongate air outlets 28F, 28R may provide respective air films (F1) (F2), labeled in FIG. 1B, flowing over and thereby heat shielding respective portions of the outer liner 12A that are axially forward (F) and axially rearward (R) of the air film starter 28.

As shown in FIG. 2A, in this embodiment the air film starter 28 further includes end walls 28W at the opposed circumferential ends of the louver 30. The end walls 28W close off the circumferential ends of the front-facing and the rear-facing elongate air outlets 28F, 28R and thereby help direct airflows out of these outlets 28F, 28R in the respective forward and rearward axial directions (i.e. relative to the central axis 10X of the combustor 10). It is contemplated that in some embodiments, one or both of the end walls 28W of the air film starter 28 may be omitted. For example, in some such embodiments, one or more end walls 28W air film starters 28 that are adjacent to a given air film starter 28 may provide for the function of the end walls 28W of the given air film starter 28.

As best shown in FIGS. 2A and 2B, in this embodiment, the air film starter 28 in this embodiment is threadingly connected to the outer liner 12A. In this embodiment, the threaded connection is provided by three equally spaced threaded studs 32 distributed along and connected to the divider wall 34. In the present embodiment, the threaded studs 32 are received through corresponding apertures 12S in the outer liner 12A and extend out of the combustion chamber 16 through the outer liner 12A. The threaded studs 32 secure the air film starter 28 in place using washers 32A and nuts 32B threaded over the studs 32 and tightened against an outer surface of the outer liner 12A.

It is contemplated that any suitable number and spacing of threaded studs 32, and any suitable corresponding number of apertures 12S in the outer liner 12A, may be used for each given air film starter 28, to suit the particular embodiment of that air film starter 28. While the threaded connection of the present embodiment helps reduce effort required in assembling the combustor 10 in at least some embodiments of the combustor 10, in other embodiments, a different threaded connection, or a different type of connection, to the outer liner 12A may be used.

For example, in other embodiments, one or more of the threaded studs 32 may be attached to a different part of the air film starter 28 to provide for the functionality described herein. For example, referring to FIG. 3 which shows an air film starter 38 that is a different embodiment of the air film starter 28, one or more of the threaded studs 32 may instead be a threaded bolt 44 extending to and/or into the louver 30 for example. In the particular example shown in FIG. 3, the bolt 44 extends into a boss 40 defined on the radially outward surface of the louver 30, and more particularly into a threaded aperture 40 defined in the boss 40 and the louver 30.

Figure 3:
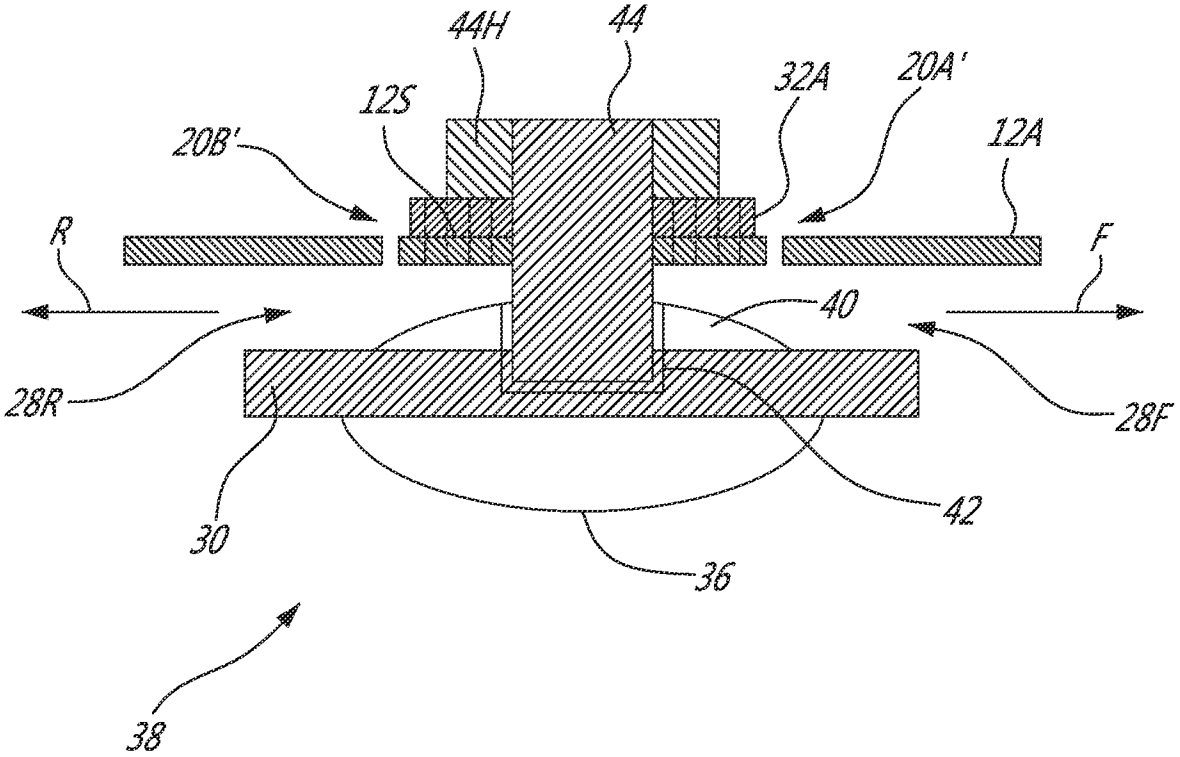
FIG. 3 is a schematic cross section view of another embodiment of the air film starter of FIG. 2A, taken along section line B-B of FIG. 2A.

In the embodiment of FIG. 3, the bolt 44 is tightened in the aperture 40, with the head 44H of the bolt 44 compressing one or more washers 32A (which may be omitted in some embodiments) against the outer surface of the outer liner 12A and compressing the outer liner against at least a part of the divider wall 34 (not visible in FIG. 3). In embodiments in which a part or all of the divider wall 34 is omitted, the boss 40 or other support structure may extend for example from the louver 30 to the outer liner 12A to provide a surface against which the bolt 44 may compress the outer liner 12A to define the spacing between the louver 30 and the outer liner 12A. Another difference between the air film starter 38 and the air film starter 28 is in the number and size of the air passages in the circumferential portion 26 of the outer liner 12A, as shown with reference numerals 20A' and 20B'.

The air passages 20A' are spaced from the front-facing axial edge 28E' of the louver 30 by an offset that may help the louver 30 redirect airflow from the air passages 20A' to form the forwardly moving air film (F). Similarly, air passages 20B' are spaced from the rear-facing axial edge 28E" of the louver 30 by an offset that may help the louver 30 redirect airflow from the air passages 20B' to form the rearwardly moving air film (R). In some embodiments, the air passages 20A', 20B' are defined as close to a circumferential centerline (which in this embodiment is a symmetry line defined through the axial centers of the bolts 44) as permitted given by each embodiment of the air film starter 38 to make each of the edge offsets a maximum offset. In an aspect, in some embodiments this may help improve at least some characteristics of the respective forwardly and rearwardly moving air films (F), (R) created by the air film starter 38. In some cases, and depending on the particular application for example, a similar spacing of the respective air passages 20 may be applied to other embodiments of film starters described herein.

Referring back to FIGS. 2A to 2C, in the present embodiment the air film starter 28 further includes thumbnail air outlets 36 that are disposed on a side of the louver 30 that is opposite the divider wall 34 and faces toward the inner liner 12B. As shown schematically with airflow arrows in FIGS. 2A to 2C, each of the thumbnail air outlets 36 is fluidly connected to at least one of the air passages 20A, 20B via one or more corresponding air passages 30A that are defined through the air film starter 28. To maintain clarity of the figures, only three of the air passages 30A appearing in FIG. 2B have been labeled.

As a non-limiting example, the thumbnail air outlet 36 shown in FIG. 2B fluidly connects to both the air passages 20A and the air passages 20B via at least two air passages defined through the louver 30, with at least one of these air passages being on each side of the divider wall 34. Also as shown, in this embodiment, the thumbnail air outlet 36 also receives a supply of air from an air source disposed outside of the liner 12 through one or more apertures/passages defined through a corresponding one of the threaded studs 32.

In some embodiments, one or more of the thumbnail air outlets 36 are supplied with air directly from an air source disposed outside of the liner 12, such as solely via one or more air passages in one or more of the studs 32 for example, and are not directly fluidly connected to any of the passages 20A or 20B. As an example, in some such embodiments, the air passage(s) 30A defined through the stud(s) 32 as shown in FIG. 2*b* may be present, while the other air passages 30A shown in the louver 30 may be absent. In an aspect, such arrangements may help improve impingement and other airflow characteristics of airflow provided by the thumbnail air outlets 36 by taking advantage of a pressure difference that may be available across the liner 12, which may be higher than a pressure difference available across the louver 30. It is contemplated that in some embodiments and applications, the thumbnail air outlets 36 may be supplied with air using any other suitable number and/or arrangement of air passages.

As shown with airflow arrows in FIG. 2A, the thumbnail air outlets 36 supply air into the combustion chamber 16 in the circumferential direction (XC) along the inward surface of the louver 30. The thumbnail air outlets 36 thereby create an air film over an entirety of the louver 30, and hence over an entirety of the circumferential portion 26 of the outer liner 12A, and thereby help heat shield the air film starters 28 and the circumferential portion 26 from the impinging flow 16GD of the combustion gases. It is contemplated that any suitable number and/or arrangement and/or shape of the thumbnail air outlets 36 may be used to provide for this functionality, for example to suit each particular embodiment of the combustor 10. It is contemplated that in some applications, the impinging flow 16GD and/or the thumbnail air outlets 36 may be omitted.

Figure 4A:
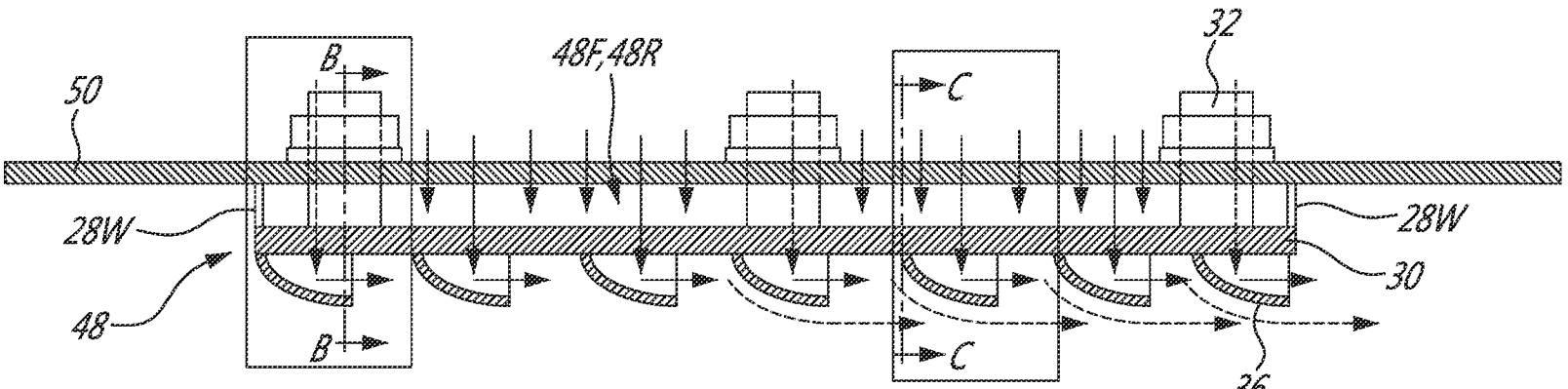
FIG. 4A is a schematic front elevation view of another embodiment of the air film starter of FIG. 2A.
Figure 4C:
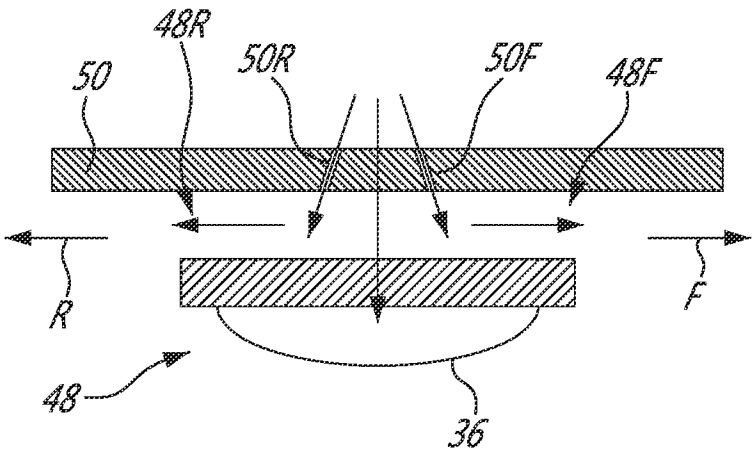
FIG. 4C is a schematic cross section view of the air film starter of FIG. 4A, taken along section line C-C of FIG. 4A.
Figure 4B:
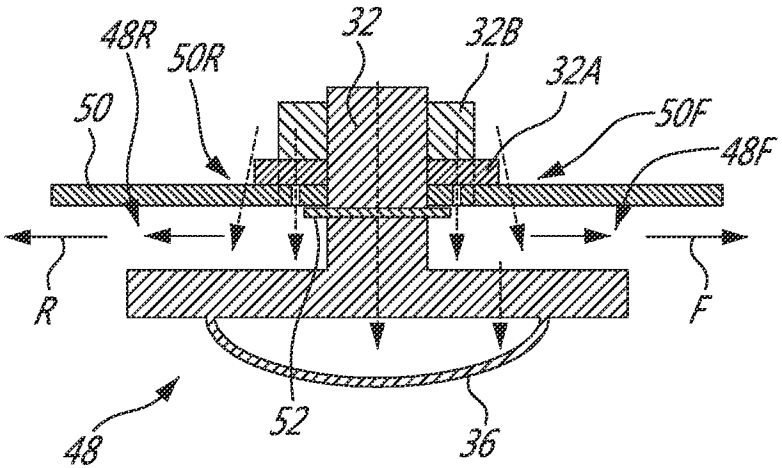
FIG. 4B is a schematic cross section view of the air film starter of FIG. 4A, taken along section line B-B of FIG. 4A.

Now referring to FIGS. 4A to 4C, an air film starter 48, which is yet another different embodiment of the air film starter 28, is shown. The air film starter 48 is similar to the air film starter 28, and therefore parts of the air film starter 48 that correspond to parts of the air film starter 28 have been labeled with the same reference numerals and will not be described again in detail.

A difference between the air film starter 48 and the air film starter 28 is that in the air film starter 48, the divider wall 34 is omitted. Accordingly, the front-facing and the rear-facing elongate air outlets 28F, 28R are directly fluidly connected to each other, and thus airflow from the air passages 50F, 50R in the circumferential portion 26 of the outer liner 12A may flow to either of the front-facing and the rear-facing elongate air outlets 28F, 28R. In this particular embodiment and although need not be the case in other embodiments, the air passages 50F, 50R are defined through the outer liner 12A at non-orthogonal angles, in directions that are tilted toward the respective ones of the front-facing and the rear-facing elongate air outlets 28F, 28R. In an aspect, this respective tilting may help direct a majority of air flowing from the air passages 50F to the front-facing elongate air outlet 28F and a majority of air flowing from the air passages 50R to the rear-facing elongate air outlet 28R.

Another difference between the air film starter 48 and the air film starter 28 is that the air film starter 48 includes an abutment 52 (shown in FIG. 4B) attached to each of the threaded studs 32, against which the nuts 32B may compress the outer liner 12A for fixing the air film starter 48 in place.

In some embodiments, one or more of the air film starters 28 and/or 38 and/or 48 of the combustor 10 may be coated with a Platinum-Aluminide coating, which has been found to help increase durability of the air film starters 28 and/or 38 and/or 48 and hence of the circumferential portion 26 of an outer liner 12A while not materially affecting a complexity of the manufacturing of the combustor 10. Also, in some embodiments, one or more of the air film starters 28 and/or 38 and/or 48 of the combustor 10 may be one of: cast, made as a single crystal, and metal injection molded, from a B1900Hf alloy. Such construction may help mitigate oxidation and may help reduce thermal gradient that may occur across at least some parts of the air film starters 28 and/or 38 and/or 48 during various modes of operation of the combustor 10.

Figure 5:
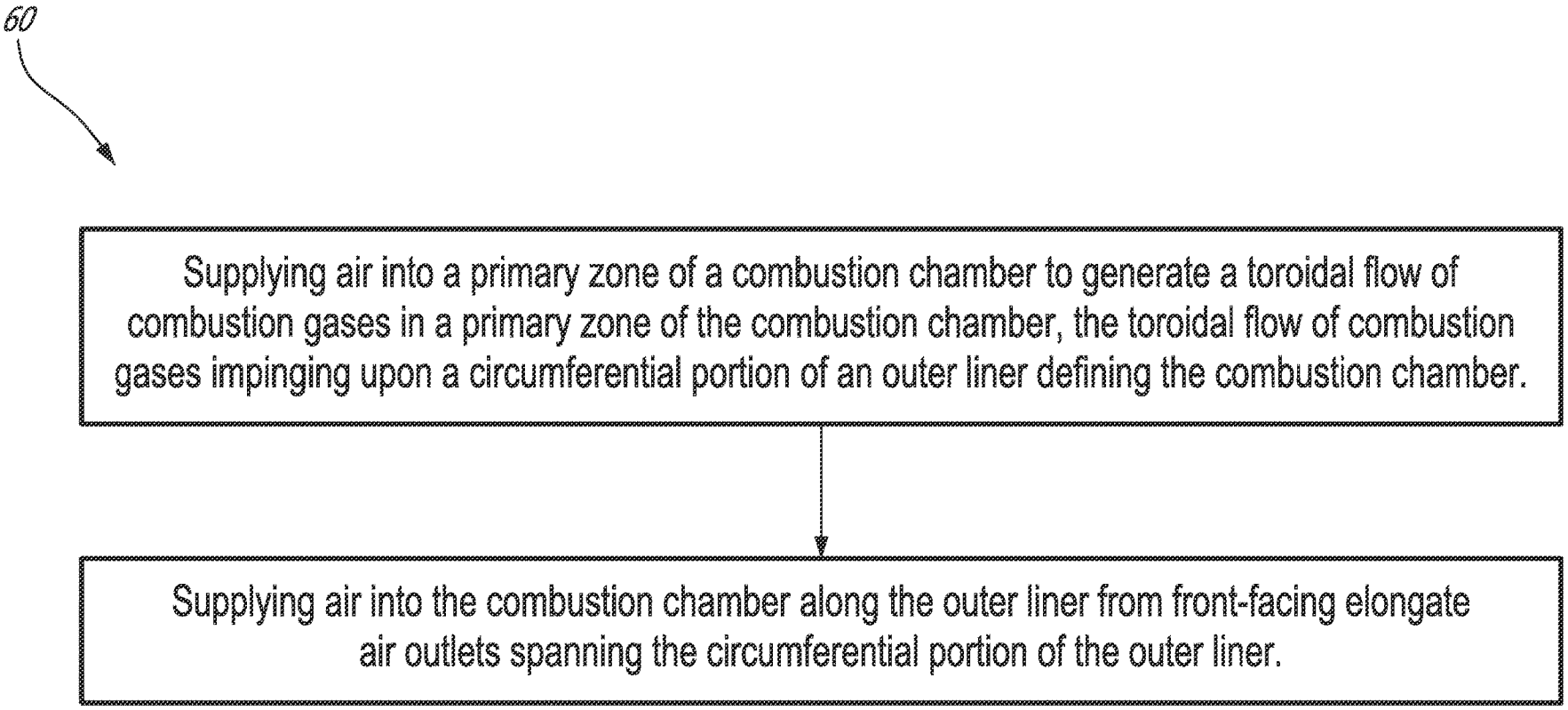
FIG. 5 is a schematic diagram showing a method of creating an air film in a combustion chamber of a combustor of an aircraft engine.
Figure 8:
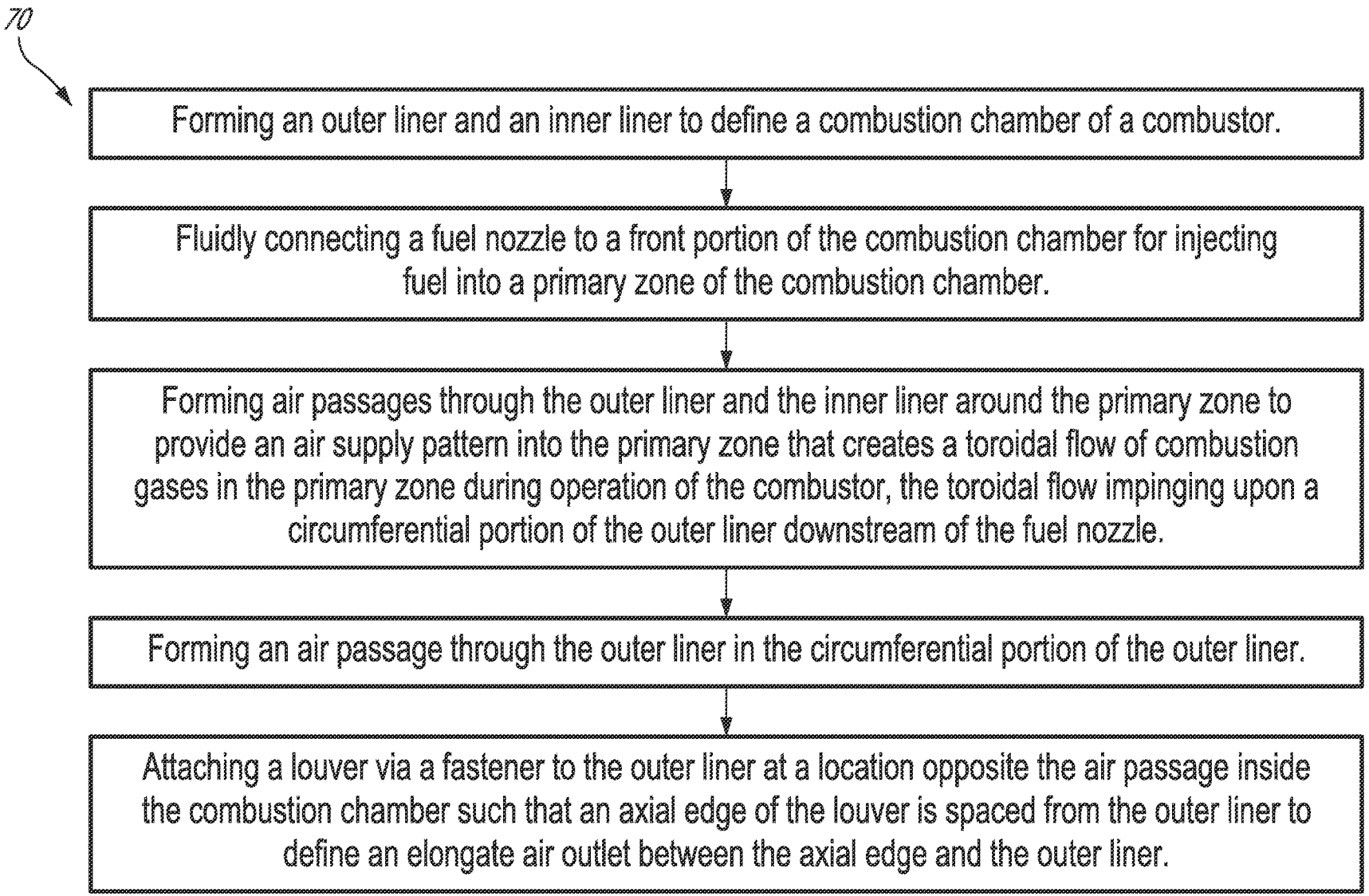

Now referring to FIG. 5, with the above non-limiting embodiments of the combustor 10 and the air film starter 28, 38, 48 in mind, the present technology also provides a method 60 of creating an air film, such as the air film (F1) shown in FIG. 1B, in a combustion chamber 16 of a combustor 10 of an aircraft engine 1A. In some embodiments, the method 60 includes, during operation of the combustor 10, supplying air (A) into a primary zone 18P of the combustion chamber 16 to generate a toroidal flow 16G of combustion gases 16G in the primary zone 18P, such that the toroidal flow 16G of combustion gases 16G impinges, as shown with arrow 16GD, upon a circumferential portion 26 of an outer liner 12A that defines the combustion chamber 16.

In some such embodiments, the method 60 may also include supplying air (A) into the combustion chamber 16 along the outer liner 12A from front-facing elongate air outlets, such as front-facing elongate air outlets 28F and/or 48F for example, which may span the circumferential portion 26 of the outer liner 12A as described herein above. In some embodiments, the method 60 may also include supplying air (A) into the combustion chamber 16 along the outer liner 12A from rear-facing elongate air outlets, such as rear-facing elongate air outlets 28R and/or 48R, which may span the circumferential portion 26 of the outer liner 12A as described herein above.

Yet further in some embodiments, the method 60 may also include supplying air (A) into the combustion chamber 16 in a circumferential direction (XC) along the circumferential portion 26 of the outer liner 12A from outlets, such as thumbnail air outlets 36, positioned radially inward (i.e. in a radial direction (XR)) of the front-facing and/or the rear-facing elongate air outlets 28F, 48F, 28R, 48F, relative to a central axis 10X of the combustor 10. As an example, this step of the method 60 may be performed by, for example, supplying air (A) from all of the thumbnail air outlets 36 of the combustor 10 along all of the louvers 30 in the circumferential direction (XC), and thereby creating an air film (F3) heat shielding at least substantially an entirety of the circumferential portion 26 of the outer liner 12A and all of the air film starters 28 and/or 38 and/or 48 that may cover the 360 degrees of the circumferential portion 26.

In a further aspect, and now referring to FIG. 6, the present technology also provides a method 70 of manufacturing a combustor 10 of an aircraft engine 1A. In some embodiments, the method includes forming an outer liner 12A and an inner liner 12B to define a combustion chamber 16 of the combustor 10, and fluidly connecting a fuel nozzle 14 to a front portion 16F of the combustion chamber 16 for injecting fuel (FF) into a primary zone 18P of the combustion chamber 10.

In some such embodiments, the method 70 also includes forming air passages 20 through the outer liner 12A and the inner liner 12B around the primary zone 18P to provide an air supply pattern into the primary zone 18P during operation of the combustor 10, which air supply pattern creates a toroidal flow of combustion gases in the primary zone 18P during operation of the combustor 10, the toroidal flow impinging upon a circumferential portion 16 of the outer liner 12A downstream of the fuel nozzle 14. One non-limiting example of such an air supply pattern is shown with arrows (A) in FIG. 1B, only some of which are labeled to maintain clarity. One non-limiting example of such a toroidal flow of combustion gases is shown with arrows in FIG. 1B, two of which are labeled 16G and 16GD.

In some such embodiments, the method 70 may further include forming an air passage, such as one of the air passages 20A, 20B, 20A', 20B' for example, through the outer liner 12A in the circumferential portion 16 of the outer liner 12A, and attaching a louver 30 via a fastener 32 to the outer liner 12A at a location opposite the air passage(s) 20A, 20B, 20A', 20B', inside the combustion chamber 16, such that an axial edge, such as the axial edge 28E' and/or the axial edge 28E", of the louver 30 is spaced from the outer liner 12A to define an elongate air outlet 28F and/or 28R between the axial edge 28E', 28E" and the outer liner 12A.

In some such embodiments, the axial edge 28E', 28E" is one of two opposed axial edges 28E', 28E" of the louver 30, and the attaching the louver 30 via the fastener 32 spaces both of the opposed axial edges 28E', 28E" from the outer liner 12A to define opposed elongate air outlets 28F and 28R, in which cases the elongate air outlet 28F or 28R referred to above may be one of the opposed elongate air outlets 28F and 28R.

In some such embodiments, and as shown in FIGS. 2B and 2C for example, the method 70 may further include attaching the fastener(s) 32 to a side of the louver 30 facing the outer liner 12 at a location, such as the central location shown, between the opposed axial edges 28E', 28E" and/or between the opposed circumferential edges of the louver 30.

The various embodiments of the engine 1A and the combustor 10 described above may be made using conventional engineering principles and manufacturing techniques.

The above description is meant to be exemplary only. One skilled in the art will recognize that changes may be made to the embodiments described without departing from the scope of the technology disclosed herein. For example, while in the above embodiments the film starters 28, 38, 48 each have one elongate air outlet 28F, 28R on each of their front-facing and rear-facing sides, in other embodiments this need not be the case. As another example, in some embodiments, one or more of the film starters 28, 38, 48 may define one or more elongate air outlet(s) on each of the front-facing and rear-facing sides, and/or may define elongate air outlet(s) on only one but not both of the front-facing and rear-facing sides.

Still other modifications which fall within the scope of the present technology will be apparent to those skilled in the art, in light of a review of this disclosure.

The invention claimed is:

1. A combustor for a gas turbine engine having a rotation axis, the combustor comprising:

a liner enclosing a combustion chamber extending along an axial direction relative to the rotation axis, the liner defining air passages through the liner into the combustion chamber, a fuel nozzle fluidly connected to the combustion chamber upstream of the air passages, a louver disposed inside the combustion chamber over the air passages, the louver extending circumferentially along the liner relative to the rotation axis from a first circumferential end of the louver to a second circumferential end of the louver and having a front-facing axial edge facing toward the fuel nozzle and a rear-facing axial edge facing away from the fuel nozzle, the louver connected to the liner by a fastener, the fastener spacing at least one of the axial edges from the liner to define an air outlet between the at least one of the axial edges and the liner, and a divider wall extending from the liner to the louver, wherein the divider wall and the louver, when viewed in a circumferential direction with respect to the rotation axis, is T-shaped.

2. The combustor of claim 1, wherein:

the at least one of the axial edges is the front-facing axial edge and the air outlet is a front-facing air outlet in a radial direction between the front-facing axial edge and the liner; and the rear-facing axial edge and the liner define a rear-facing air outlet between the rear-facing axial edge and the liner, the rear-facing air outlet extending from the first circumferential end of the louver to the second circumferential end of the louver.

3. The combustor of claim 2, wherein the divider wall disposed between the front-facing and rear-facing air outlets and between the air passages such a first subset of the air passages supply air to the front-facing air outlet and a second subset of the air passages supply air to the rear-facing air outlet.

4. The combustor of claim 3, wherein:

the liner includes an annular outer liner extending about a central axis of the combustor;

the louver and the divider wall extend circumferentially along a portion of the annular outer liner relative to the central axis; and an end wall is disposed at each of the first and second circumferential ends of the louver, the end walls defining the front-facing and rear-facing air outlets.

5. The combustor of claim 4, wherein the front-facing air outlet has a total airflow exit area that is between 2 to 3 times a total airflow exit area of the first subset of the air passages supplying the air to the front-facing air outlet, and the rear-facing air outlet has a total airflow exit area that is between 2 to 3 times a total airflow exit area of the second subset of the air passages supplying the air to the rear-facing air outlet.

6. The combustor of claim 5, wherein the total airflow exit area of the first subset of the air passages supplying the air to the front-facing air outlet is greater than the total airflow exit area of the second subset of the air passages supplying the air to the rear-facing air outlet.

7. The combustor of claim 5, comprising a plurality of thumbnail air outlets disposed on a side of the louver opposite the divider wall, each of the thumbnail air outlets being fluidly connected to at least one of: the first subset of the air passages, the second subset of the air passages, and an air source disposed outside of the liner;

the combustion chamber includes a primary zone in a front portion of the combustion chamber, and a dilution zone downstream of the primary zone;

the louver, the divider wall, the first subset of the air passages, and the second subset of air passages are positioned between the primary zone and the dilution zone;

the first subset of air passages defined through the liner opening into the primary zone of the combustion chamber;

the liner includes an annular inner liner, the annular inner liner defining at least one primary jet air passage through the annular inner liner, the at least one primary jet air passage opening into the combustion chamber between the primary zone and the dilution zone; and the first subset of air passages opening into the primary zone and the at least one primary jet air passage are sized and oriented such that air flowing into the combustion chamber during operation through the first subset of air passages opening into the primary zone and the at least one primary jet air passage generates a toroidal flow of combustion gases in the primary zone, the toroidal flow of combustion gases impinging upon the louver and the thumbnail air outlets.

8. The combustor of claim 7, wherein:

the louver, the divider wall, the front-facing and rear-facing air outlets, and the thumbnail air outlets are part of an air film starter threadingly attached to the annular outer liner;

the air film starter is a plurality of film starters distributed circumferentially along the annular outer liner;

the fuel nozzle is a plurality of fuel nozzles disposed upstream of the plurality of film starters; and each fuel nozzle of the plurality of fuel nozzles aligns axially with at least one film starter of the plurality of film starters.

9. The combustor of claim 8, wherein the plurality of film starters covers substantially an entirety of a circumference of the annular outer liner.

10. The combustor of claim 4, wherein the louver has a rectangular cross-section.

11. A combustor for a gas turbine engine having a rotation axis, the combustor comprising:

an outer liner and an inner liner defining an annular combustion chamber between the outer liner and the inner liner;

a fuel nozzle disposed in a front portion of the combustion chamber;

a plurality of air passages defined through the outer liner downstream of the fuel nozzle; and an air film starter disposed inside the combustion chamber and connected to the outer liner via a threaded stud, the air film starter defining:

a front-facing elongate air outlet directing air from at least one of the plurality of air passages along the outer liner toward the fuel nozzle when the combustor is in use; and a rear-facing elongate air outlet directing air from at least one of the plurality of air passages along the outer liner away from the fuel nozzle when the combustor is in use, a louver disposed inside the combustion chamber proximate to and spaced from the outer liner, and front and rear axial edges of the louver define the front-facing and rear-facing elongate air outlets, respectively, between the front and rear axial edges, respectively, and the outer liner, a divider wall extending from the outer liner to the louver, wherein the divider wall and the louver, when viewed in a circumferential direction with respect to the rotation axis, is T-shaped.

12. The combustor of claim 11, wherein the front and rear axial edges are free of contact with the outer liner.

13. The combustor of claim 12, wherein:

the front-facing elongate air outlet extends radially inward of the outer liner; and the rear-facing elongate air outlet extends radially inward of the outer liner.

14. The combustor of claim 13, wherein the threaded stud includes a plurality of bolts distributed circumferentially along the outer liner and extending into the combustion chamber through the outer liner and connecting to the air film starter; or a plurality of threaded studs extending from the air film starter out of the combustion chamber through the outer liner.

15. The combustor of claim 14, wherein the divider wall is between opposed circumferential ends of the louver, and the air film starter includes an end wall at each of the opposed circumferential ends, the end walls defining the front-facing and rear-facing elongate air outlets, the divider wall fluidly separating the plurality of air passages into:

at least a first air passage supplying the air to the front-facing elongate air outlet when the combustor is in use, and at least a second air passage supplying the air to the rear-facing elongate air outlet when the combustor is in use.

16. The combustor of claim 14, wherein the air film starter is coated with a Platinum-Aluminide coating.

17. The combustor of claim 14, wherein the air film starter is one of: cast, made as a single crystal, and metal injection molded, from a B1900Hf alloy.

18. A method of manufacturing a combustor of an aircraft engine having a rotation axis, comprising:

forming an outer liner and an inner liner to define a combustion chamber of the combustor;

fluidly connecting a fuel nozzle to a front portion of the combustion chamber for injecting fuel into a primary zone of the combustion chamber;

forming first air passages through the outer liner and the inner liner around the primary zone to provide an air supply pattern into the primary zone that creates a toroidal flow of combustion gases in the primary zone during operation of the combustor, the toroidal flow impinging upon a circumferential portion of the outer liner downstream of the fuel nozzle;

forming a second air passage through the outer liner in the circumferential portion of the outer liner;

attaching a louver via a fastener to the outer liner at a location opposite the second air passage inside the combustion chamber such that an axial edge of the louver is spaced from the outer liner to define an elongate air outlet between the axial edge and the outer liner, and the louver having a divider wall extending from the outer liner to the louver, wherein the divider wall and the louver, when viewed in a circumferential direction with respect to the rotation axis, is T-shaped.

19. The method of claim 18, wherein the axial edge is one of two opposed axial edges of the louver, and the attaching the louver via the fastener spaces both of the opposed axial edges from the outer liner to define opposed elongate air outlets, the elongate air outlet being one of the opposed elongate air outlets.

20. The method of claim 19, comprising attaching the fastener to a side of the louver facing the outer liner at a location between the opposed axial edges.

* * * * *